US007334885B2

(12) United States Patent
Namekawa et al.

(10) Patent No.: US 7,334,885 B2
(45) Date of Patent: Feb. 26, 2008

(54) DISTRIBUTION CONTAINER AND DISTRIBUTION METHOD FOR LIQUID-DISCHARGING HEAD

(75) Inventors: Takumi Namekawa, Kanagawa (JP); Masato Nakamura, Kanagawa (JP); Shigeyoshi Hirashima, Kanagawa (JP)

(73) Assignee: Sony Corporation, Tokyo (JP)

( * ) Notice: Subject to any disclaimer, the term of this patent is extended or adjusted under 35 U.S.C. 154(b) by 263 days.

(21) Appl. No.: 11/065,266

(22) Filed: Feb. 24, 2005

(65) Prior Publication Data

US 2005/0225613 A1 Oct. 13, 2005

(30) Foreign Application Priority Data

Mar. 1, 2004 (JP) ..... P2004-056252

(51) Int. Cl.
*B41J 2/175* (2006.01)

(52) U.S. Cl. ..... 347/85

(58) Field of Classification Search ..... 347/49, 347/85, 86, 87, 28
See application file for complete search history.

(56) References Cited

U.S. PATENT DOCUMENTS

| | | | | |
|---|---|---|---|---|
| 4,148,041 | A * | 4/1979 | Rosenstock | 347/28 |
| 5,094,269 | A * | 3/1992 | Agulia | 137/564.5 |
| 5,358,009 | A * | 10/1994 | Cambell | 137/899 |
| 6,375,315 | B1 * | 4/2002 | Steinmetz et al. | 347/86 |
| 6,554,412 | B1 * | 4/2003 | Seino et al. | 347/86 |
| 6,609,863 | B1 * | 8/2003 | Morioka et al. | 410/68 |
| 6,851,797 | B2 * | 2/2005 | Suda et al. | 347/85 |
| 6,958,113 | B2 * | 10/2005 | Mizohata et al. | 204/224 R |

* cited by examiner

*Primary Examiner*—Anh T. N. Vo
(74) *Attorney, Agent, or Firm*—Sonnenschein Nath & Rosenthal LLP

(57) ABSTRACT

A distribution container containing storage liquid is mounted in a cartridge holding section of a line head to substitute for an ink cartridge during transportation and storage of the line head. The storage liquid prevents air from flowing into the line head through nozzles, and thereby avoids discharging failure, for example, no discharging or insufficient discharging of ink.

11 Claims, 11 Drawing Sheets

FIG. 9 – PRIOR ART
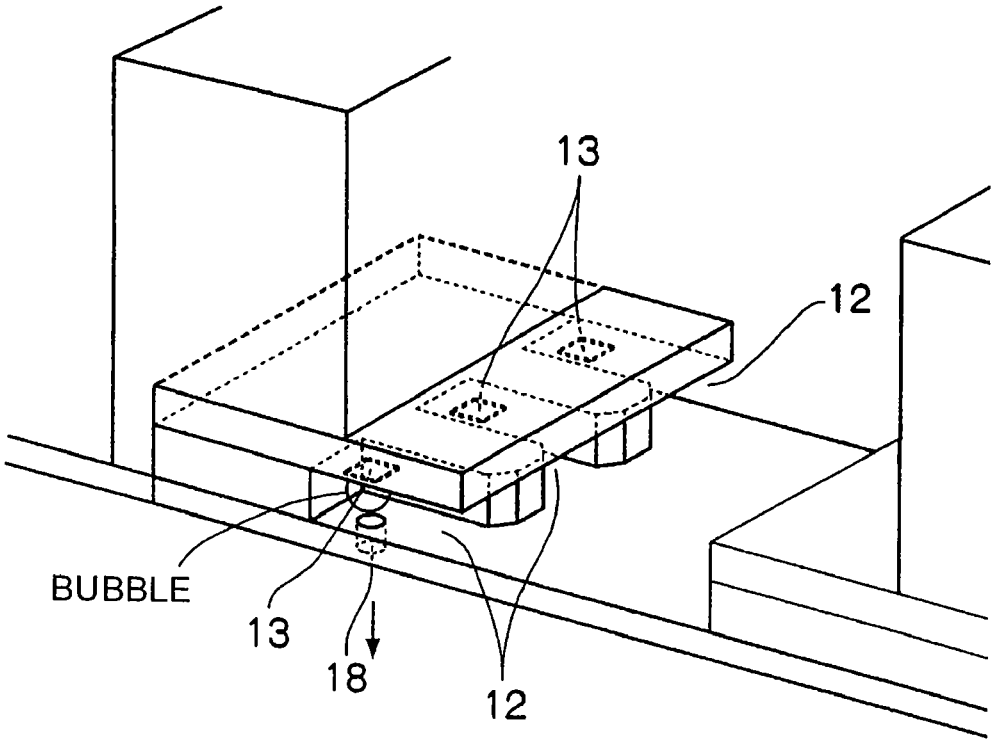

FIG. 10A – PRIOR ART
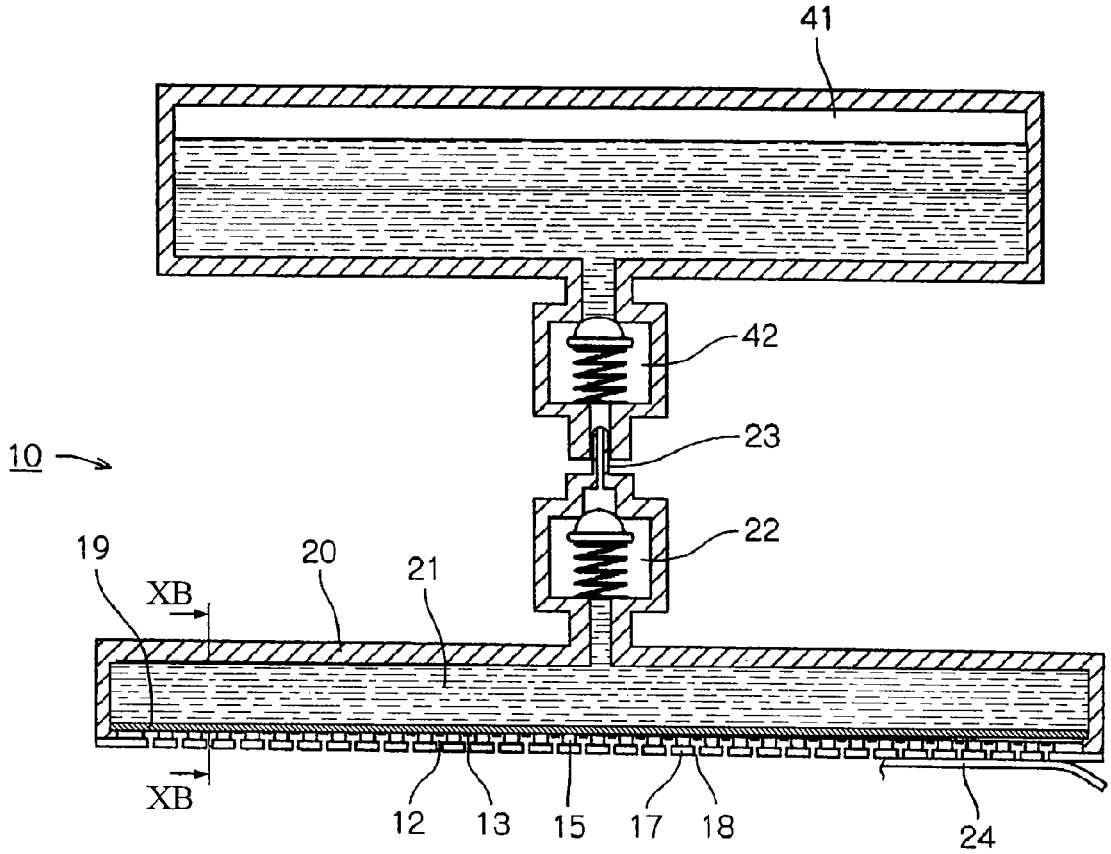
FIG. 10B – PRIOR ART
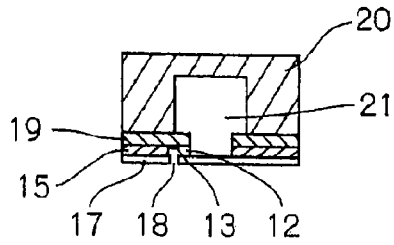

FIG. 11 – PRIOR ART
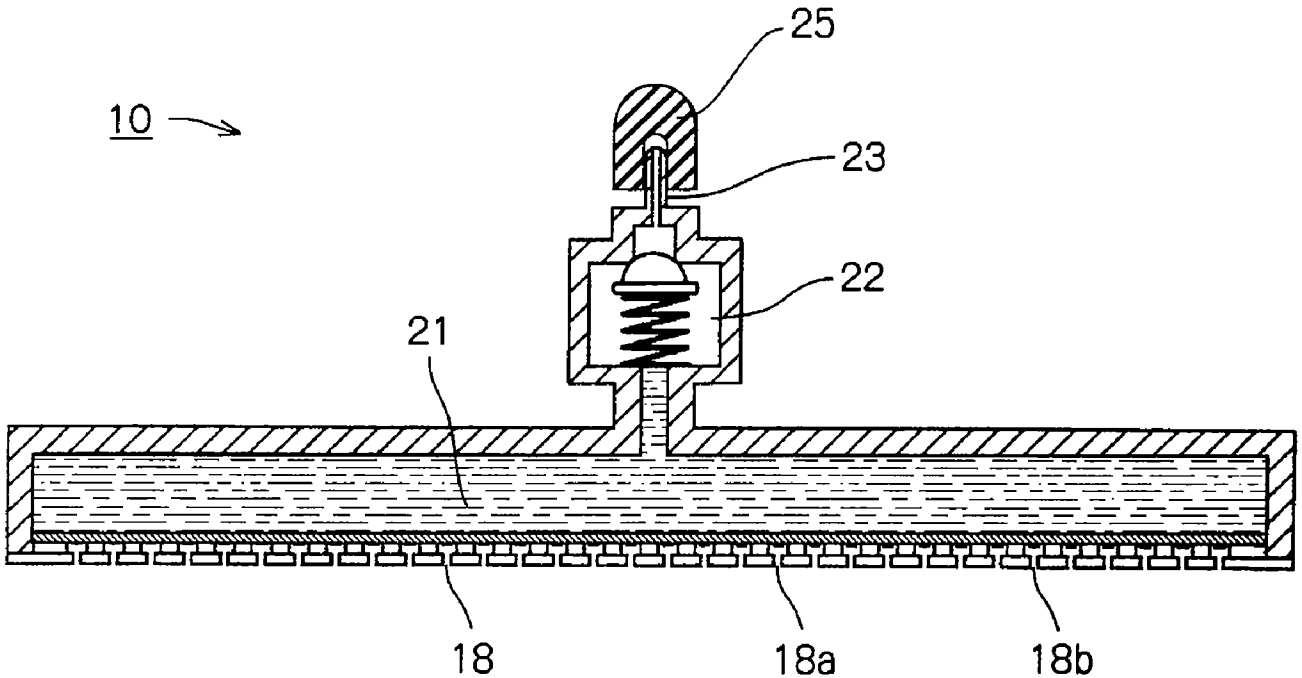

DISTRIBUTION CONTAINER AND DISTRIBUTION METHOD FOR LIQUID-DISCHARGING HEAD

RELATED APPLICATION DATA

The present application claims priority to Japanese Application(s) No(s). P2004-056252 filed Mar. 1, 2004, which application(s) is/are incorporated herein by reference to the extent permitted by law.

BACKGROUND OF THE INVENTION

1. Field of the Invention

The present invention relates to a distribution container that is mounted in a liquid-discharging head of, for example, an ink-jet printer during transportation and storage to substitute for a liquid container containing liquid to be discharged, and to a distribution method for transporting and storing a liquid-discharging head with such a distribution container mounted therein. More particularly, the present invention relates to a technique of preventing air from flowing from a nozzle of a liquid-discharging head.

2. Description of the Related Art

Known ink-jet printers have a head including a plurality of nozzles arranged linearly (a type of liquid-discharging head). An ink cartridge (a type of liquid container) is mounted in the head, and ink in the ink cartridge is discharged from the head for printing. That is, substantially circular dots are formed on printing paper serving as a recording medium opposing an ink-discharging surface of the head by sequentially discharging ink from the nozzles onto the printing paper, thereby expressing images and characters by dots arranged vertically and horizontally.

FIG. 9 is a perspective view of a thermal head that performs thermal printing as an ink discharging method in which ink is discharged by thermal energy. As shown in FIG. 9, the thermal head includes ink chambers 12 filled with ink, and heating resistors 13 respectively provided in the ink chambers 12. When ink in each ink chamber 12 is rapidly heated by the heating resistor 13, a bubble is produced in the ink on the heating resistor 13, and the ink is discharged from a nozzle 18, as shown by the arrow, by the energy generated when the bubble is produced.

From the viewpoint of structure, heads are divided into a serial head that moves in the width direction of a recording medium for printing, and a line head including multiple head sections that are arranged in the width direction of a recording medium in accordance with the printing width.

FIG. 10A is a cross-sectional view of a line head in which an ink cartridge is mounted, and FIG. 10B is a cross-sectional view taken along line XB-XB in FIG. 10A.

In a line head 10 shown in FIGS. 10A and 10B, a nozzle sheet 17 having a plurality of equally spaced nozzles 18 is bonded to a head chip 19 having a plurality of heating resistors 13 arranged in one direction while a barrier layer 15 defining ink chambers 12 is provided therebetween. The nozzles 18 correspond to the ink chambers 12 and the heating resistors 13, respectively.

A common channel member 20 is provided on the head chip 19. An ink common channel 21 defined by the common channel member 20 communicates with all the ink chambers 12. The center of the common channel member 20 is connected to an ink cartridge 41 via an ink supply tube 23 having a valve device 22. The ink cartridge 41 also has a valve device 42.

Ink in the ink cartridge 41 is supplied to the common channel 21 through the valve devices 42 and 22, and fills the ink chambers 12. When the ink is discharged from the ink chambers 12, the inner pressure of the common channel 21 becomes negative, and valves in the valve devices 22 and 42 are pushed down. Consequently, the valve devices 22 and 42 are opened, and ink is supplied again from the ink cartridge 41 to the common channel 21, and fills the ink chambers 12 that have discharged the ink. Accordingly, when the ink cartridge 41 is mounted in the line head 10, the ink chambers 12 are constantly filled with ink.

Ink sometimes leaks from the nozzles 18 because of environmental factors, for example, vibrations during transportation of the ink-jet printer, and the storage temperature. When leakage occurs, the inner pressure of the common channel 21 becomes negative, and the valve device 22 is opened while the ink cartridge 41 is not mounted. Therefore, air flows into the common channel 21, and produces bubbles in the ink. If the bubbles enter the ink chambers 12, even when the heating resistors 13 are heated for printing, discharging failure occurs, for example, no ink is discharged or ink is insufficiently discharged. This reduces the printing quality.

Japanese Unexamined Patent Application Publication No. 2003-170606 discloses a technique of preventing ink leakage. In this technique, as shown in FIG. 10A, a protection sheet 24 is bonded to the nozzle sheet 17 having the nozzles 18 during transportation of the ink-jet printer so that ink does not leak from the nozzles 18 and air does not flow therein. During use, the protection sheet 24 is separated from the nozzle sheet 17 to expose all the nozzles 18.

In the above-described technique, however, when the protection sheet 24 is separated from the nozzle sheet 17, a force for vertically lifting the nozzle sheet 17 acts because of the adhesive force of the protection sheet 24. This may damage an ink-discharging surface of the nozzle sheet 17. Furthermore, since the separated protection sheet 24 remains adhesive, for example, when the finger or cloth of the user touches the protection sheet 24, it may be soiled with ink adhering to the adhesive surface of the protection sheet 24.

It is conceivable to solve the above problem by reducing the adhesive force of the protection sheet 24.

However, this method is not practical because the probability of ink leakage increases. Since the nozzle sheet 17 is large particularly in the line head 10, it is fundamentally difficult to bond the protection sheet 24 to the nozzle sheet 17 so that ink does not leak from all the nozzles 18. When the adhesive force is reduced in such a condition, reliability is seriously reduced.

In addition, it is difficult for the users themselves to bond the protection sheet 24 to cover all the nozzles 18, for example, during storage of the line head 10.

FIG. 11 is a cross-sectional view of a line head having a cap.

In a line head 10 shown in FIG. 11, an ink supply tube 23 is covered with a rubber cap 25, instead of using the protection sheet 24 shown in FIG. 10A. Therefore, even when a valve device 22 is opened, air does not flow from the ink supply tube 23.

In this line head 10, air is prevented from flowing from the ink supply tube 23 into a common channel 21 filled with ink, but flows from nozzles 18. That is, when ink leaks from any of the nozzles 18 and the inner pressure of the common channel 21 becomes negative, air flows from the other nozzles 18 because the ink supply tube 23 is covered with the cap 25. In particular, since the line head 10 has a large number of nozzles 18, ink leaks and air flows from multiple nozzles 18.

SUMMARY OF THE INVENTION

Accordingly, it is an object of the present invention to avoid discharging failure, such as no discharging and insufficient discharging of ink by preventing air from flowing into a liquid-discharging head during transportation and storage, without bonding a protection sheet to a nozzle sheet.

In order to achieve the above object, according to one aspect, the present invention provides a distribution container mountable in a container holding section of a liquid-discharging head that discharges liquid from a liquid container mounted in the container holding section through a nozzle. The distribution container includes a container body containing storage liquid, and a mounting portion to be attached to the container holding section, and is mounted in the container holding section to substitute for the liquid container during transportation and storage of the liquid-discharging head so that the storage liquid in the container body prevents air from flowing into the liquid-discharging head from the nozzle.

According to another aspect, the present invention provides a distribution method for a liquid-discharging head that discharges liquid from a liquid container mounted in a container holding section through a nozzle. In the distribution method, during transportation and storage of the liquid-discharging head, a distribution container containing storage liquid is mounted in the container holding section so that the storage liquid prevents air from flowing into the liquid-discharging head through the nozzle.

According to the present invention, the distribution container is mounted in the liquid-discharging head, instead of the liquid container, during distribution such as transportation and storage. Since the distribution container is mounted in the container holding section, even when liquid leaks from the nozzle, air does not enter the liquid-discharging head from the side of the container holding section.

The storage liquid is contained in the distribution container. For example, when the inner pressure of the liquid-discharging head becomes negative because of leakage of liquid from the nozzle, the storage liquid is supplied from the distribution container to remove the negative pressure. Consequently, air is prevented from entering the liquid-discharging head not only from the container holding section, but also from the nozzle.

BRIEF DESCRIPTION OF THE DRAWINGS

FIG. 9 is a perspective view of a thermal head that discharges ink by thermal energy;

FIGS. 10A and 10B are cross-sectional views of a line head to which an ink cartridge is attached; and FIG. 11 is a cross-sectional view of a line head having a cap.

DESCRIPTION OF THE PREFERRED EMBODIMENTS

Embodiments of the present invention will be described below with reference to the attached drawings.

In the following description of the embodiments, a liquid-discharging head corresponds to a line head in an ink-jet line printer for A4-size paper (210 mm in width), liquid to be discharged from nozzles corresponds to ink, a liquid container corresponds to an ink cartridge, and a container holding section corresponds to a cartridge holding section.

Figure 1:
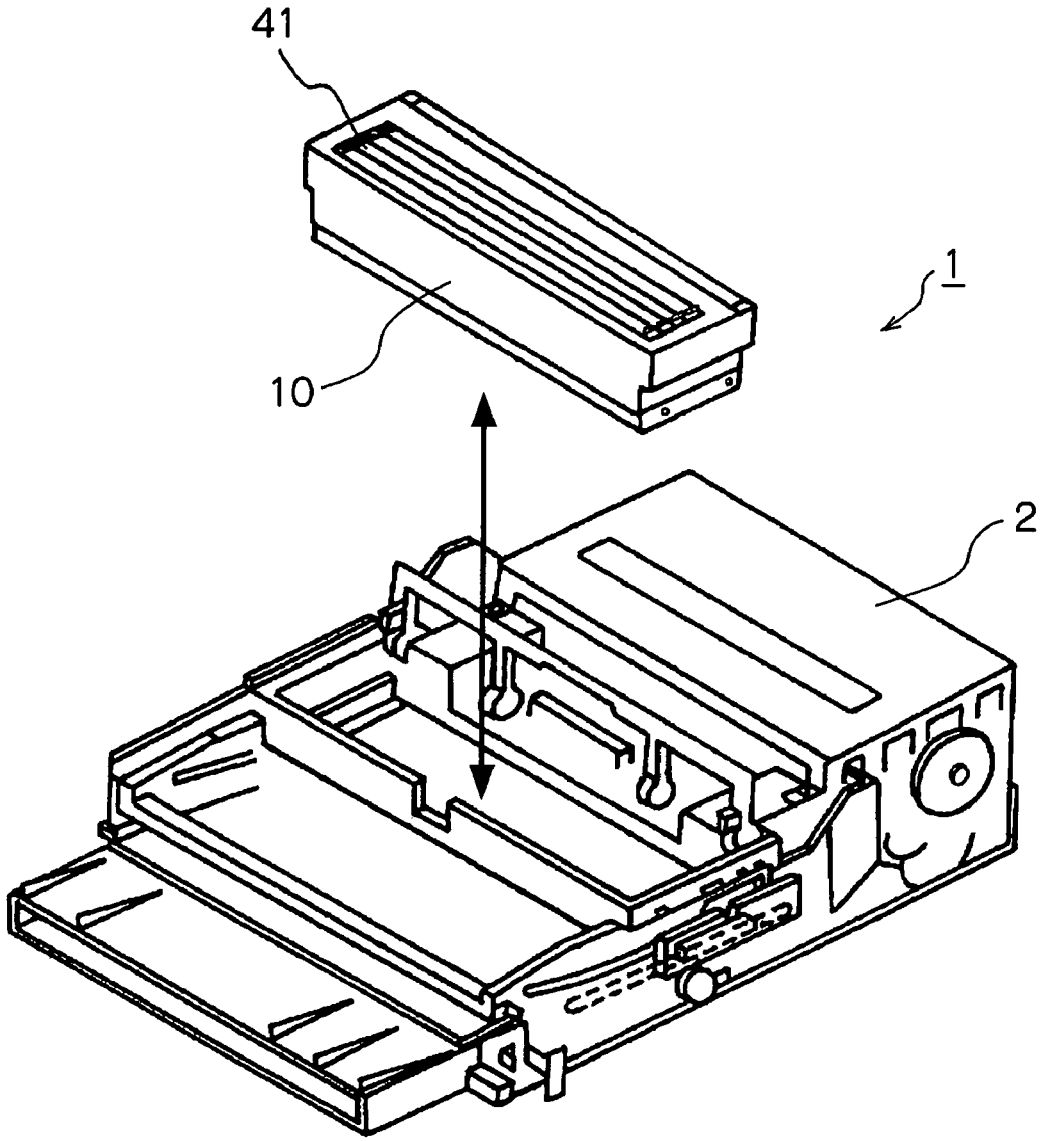
FIG. 1 is a perspective view of an ink-jet printer.

FIG. 1 is a perspective view of an ink-jet printer 1.

Referring to FIG. 1, the ink-jet printer 1 includes a line head 10 for discharging ink, and a printer body 2 in which the line head 10 is mounted. The printer body 2 includes, for example, a supply tray for printing paper serving as a recording medium, an ejection tray, a feeding device, and a control circuit.

The line head 10 can be put in and taken out from the printer body 2, as shown by the arrow. Ink cartridges 41 are detachably mounted in the line head 10. That is, in the ink-jet printer 1 shown in FIG. 1, the line head 10 and the ink cartridges 41 can be easily replaced as consumables.

Figure 2:
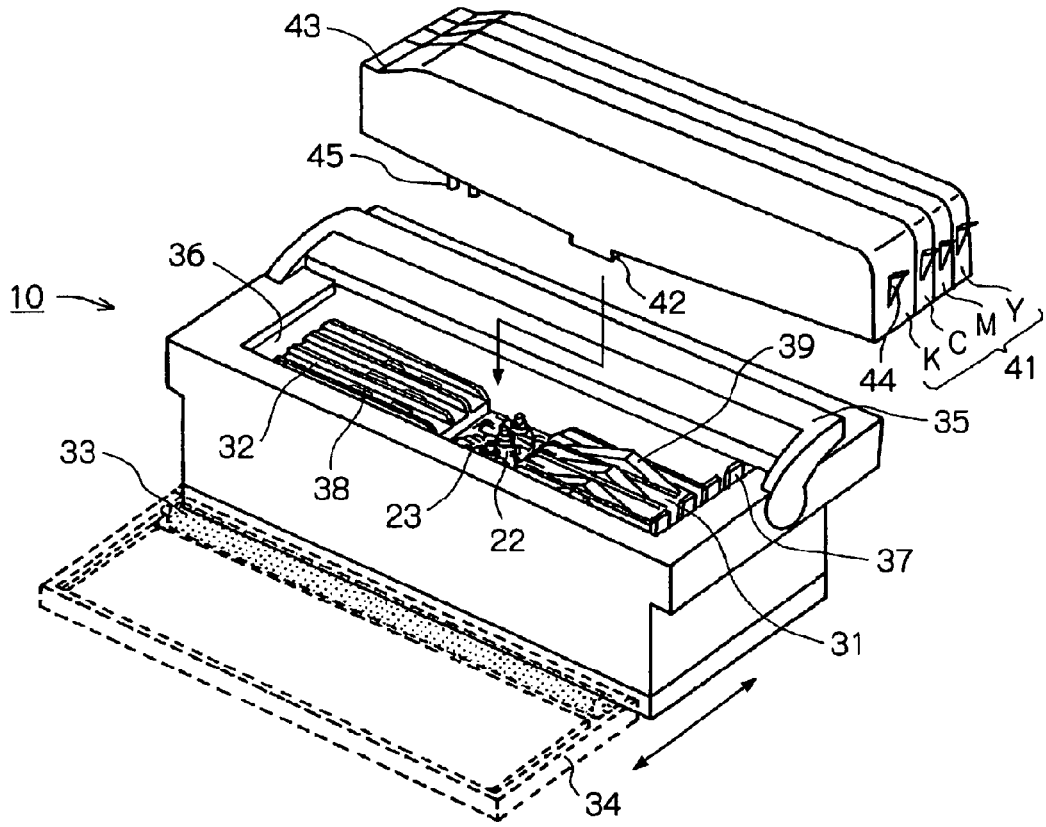
FIG. 2 is a perspective view of a line head.

FIG. 2 is a perspective view of the line head 10.

As shown in FIG. 2, the line head 10 includes four ink cartridges 41 containing inks of four colors, Y (yellow), M (magenta), C (cyan), and K (black), and four cartridge holding sections 31 that accommodate the ink cartridges 41, respectively.

The cartridge holding sections 31 are concave, and have such a size as to accommodate the corresponding ink cartridges 41. Partition walls 32 are provided on bottom faces of the cartridge holding sections 31 to separate the sections 31. A black-ink cartridge 41 containing black ink, of the four ink cartridges 41, has an ink capacity larger than the other ink cartridges 41 because the amount of consumption of the black ink is the largest in general printing. For this reason, the black-ink cartridge 41 is wide. The distance between the partition walls 32 is determined in accordance with the width of the corresponding ink cartridge 41.

Four ink supply tubes 23 protrude from the bottom faces of the cartridge holding sections 31, and are connected to valve devices 42 of the corresponding ink cartridges 41 when the ink cartridges 41 are mounted. That is, when the ink cartridges 41 are mounted in the cartridge holding sections 31, as shown by the down-pointing arrow in FIG. 2, upper ends of the ink supply tubes 23 are fitted in bottom portions of the valve devices 42, thereby forming ink supply paths. Valve devices 22 are also provided under the ink supply tubes 23.

The line head 10 also includes a cleaning roller 33 provided to protect an ink discharging surface and to absorb extra ink remaining on the ink discharging surface, a head cap 34 that is opened and closed, as shown by the double-headed arrow in FIG. 2, and a handle 35 used to take the line head 10 out of the printer body 2 shown in FIG. 1.

The four ink cartridges 41 contain inks of four colors, Y (yellow), M (magenta), C (cyan), and K (black), respectively, as described above.

Accordingly, the line head 10 shown in FIG. 2 can print a color image by discharging the inks of four colors according to printing data.

Each of the ink cartridges 41 has the valve device 42 in order to prevent ink from leaking outside, as described above. The valve device 42 is provided on the center of the bottom face of the ink cartridge 41. Since the bottom face of the ink cartridge 41 is the deepest at the center where the valve device 42 is provided, ink concentrates toward the valve device 42. Consequently, the ink in the ink cartridge 41 can be consumed without waste.

The ink cartridge 41 also includes a fitting step portion 43 and a fixed projection 44 that allow the ink cartridge 41 to be properly mounted in the corresponding cartridge holding section 31.

The ink cartridge 41 further includes an identification protuberance 45 for identification of the ink color.

The fitting step portion 43 is provided on the upper surface at one longitudinal end of the ink cartridge 41, and is fitted in a space 36 of the cartridge holding section 31, as will be described later. The fixed projection 44 is provided on a side face at the other longitudinal end of the ink cartridge 41, and is engaged with an elastic latch lever 37 in the cartridge holding section 31, as will be described later.

The identification protuberance 45 is provided for identification of the type of the ink cartridge 41, and is fitted in an identification recess 38 provided on the bottom face of the cartridge holding section 31. When the ink cartridges 41 respectively containing the Y, M, C, and K inks are mounted at wrong positions, printing in right colors may be impossible.

In order for the ink cartridges 41 to be properly mounted in predetermined positions, the identification protuberances 45 are provided at different positions among the four ink cartridges 41 corresponding to the identification recesses 38 of the cartridges holding sections 31. Consequently, when the identification protuberance 45 of any of the ink cartridge 41 is fitted in the identification recess 38, it is noticed that the ink cartridge 41 is properly mounted.

A description will now be given of a procedure for mounting each ink cartridge 41 in the corresponding cartridge holding section 31.

In order to mount the ink cartridge 41, first, the fitting step portion 43 is obliquely fitted as a fitting end into the space 36 of the cartridge holding section 31. The ink cartridge 41 is then turned down on the fitted fitting step portion 43, and is pushed in the cartridge holding section 31.

By the push of the ink cartridge 41, the fixed projection 44 is brought into contact with the elastic latch lever 37 of the cartridge holding section 31, and pushes the latch lever 37 outward. When the ink cartridge 41 is further pushed and is properly positioned in the cartridge holding section 31, the pushed latch lever 37 returns into its original state. Consequently, the fixed projection 44 and the latch lever 37 engage with each other, thereby preventing the ink cartridge 41 from falling off.

In this state, the ink cartridge 41 is pushed upward by an elastic member 39 provided on the bottom face of the cartridge holding section 31. Therefore, the latch lever 37 and the fixed projection 44 are properly engaged with each other, and the ink cartridge 41 is reliably mounted in the cartridge holding section 31. In order to detach the ink cartridge 41, the latch lever 37 is shifted outward. The fixed projection 44 is thereby disengaged from the latch lever 37, and simultaneously, the ink cartridge 41 is caused to slightly stick out from the cartridge holding section 31 by the action of the elastic member 39.

Figure 3:
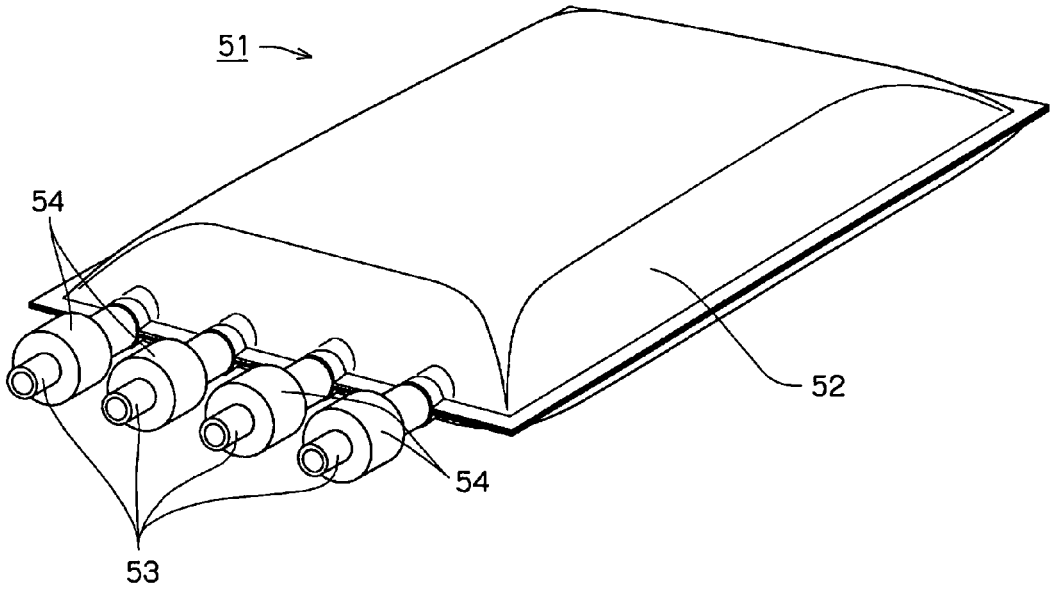
FIG. 3 is a perspective view of a distribution container according to a first embodiment of the present invention.

FIG. 3 is a perspective view of a distribution container according to a first embodiment of the present invention.

As shown in FIG. 3, a distribution container 51 of the first embodiment includes a container body 52 and four mounting portions 53. The container body 52 is made of a flexible vinyl pack, and contains storage liquid. Since the container body 52 is flexible, the internal volume thereof can vary depending on the amount of the storage liquid. The internal pressure of the container body 52 is constantly kept equal to the atmospheric pressure.

The distribution container 51 is attached to the cartridge holding sections 31 of the line head 10 shown in FIG. 2 at the mounting portions 53. That is, the ink supply tubes 23 of the cartridge holding sections 31 can be fitted in the corresponding mounting portions 53. Valve devices 54 are provided between the mounting portions 53 and the container body 52 to prevent the storage liquid from leaking from the container body 52.

Figure 4:
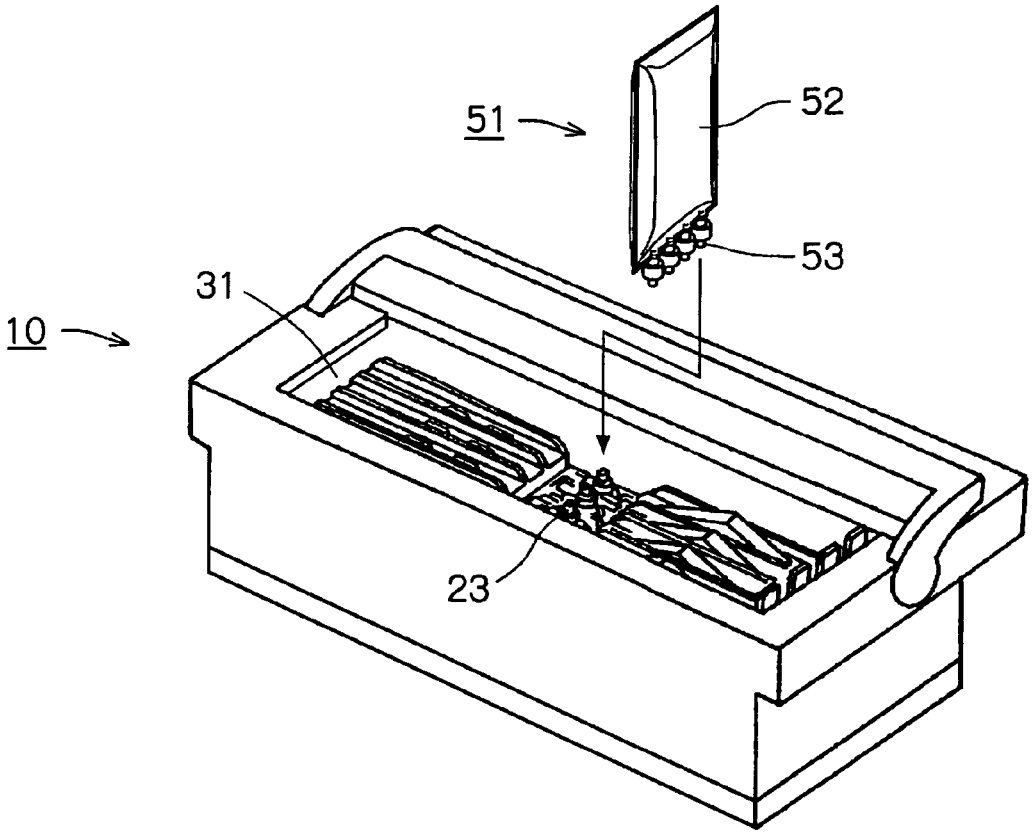
FIG. 4 is a perspective view showing a state before the distribution container of the first embodiment is mounted in cartridge holding sections of the line head.

FIG. 4 is a perspective view showing a state before the distribution container 51 of the first embodiment is attached to the cartridge holding sections 31 of the line head 10.

As shown in FIG. 4, the distribution container 51 can be simultaneously attached to the cartridge holding sections 31 so as to substitute for the ink cartridges 41 shown in FIG. 2.

The distribution container 51 is attached by being inserted in the cartridge holding sections 31, as shown by the arrow. The upper ends of the ink supply tubes 23 are fitted in the mounting portions 53, and supply paths are thereby formed for the storage liquid in the container body 52. The storage liquid is obtained by removing pigments from Y, M, C, and K inks.

Figure 5:
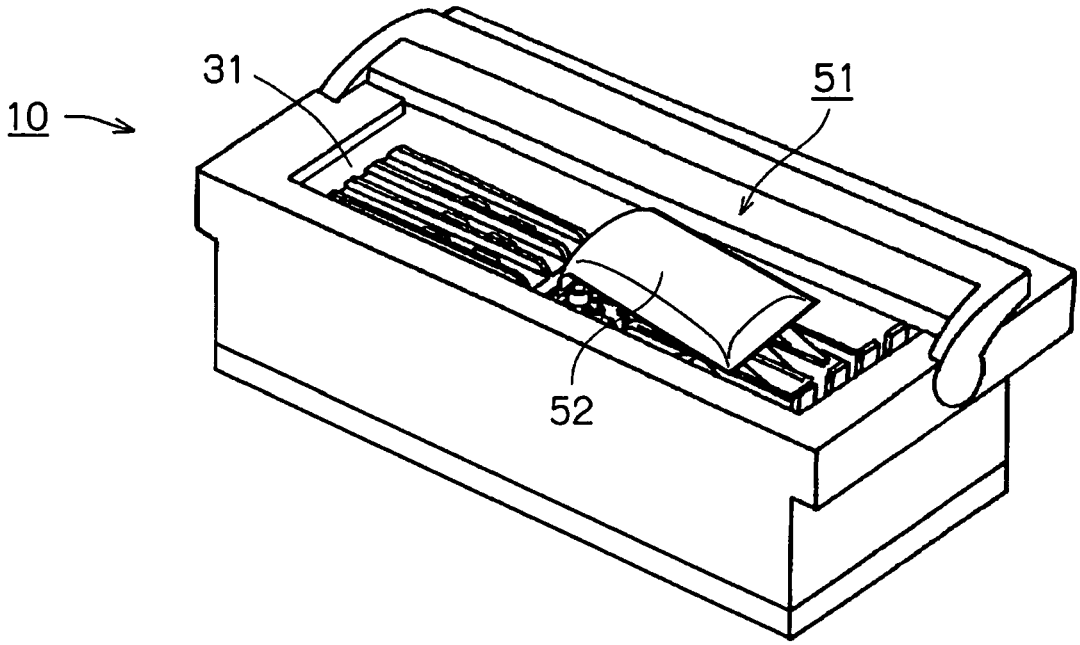
FIG. 5 is a perspective view showing a state after the distribution container of the first embodiment is mounted in the cartridge holding sections of the line head.

FIG. 5 is a perspective view showing a state after the distribution container 51 is attached to the cartridge holding sections 31 of the line head 10.

When the distribution container 51 is attached to the cartridge holding sections 31, as shown in FIG. 4, it is placed outside the cartridge holding sections 31. Therefore, the flexible container body 52 is folded so that the distribution container 51 is placed inside the cartridge holding sections 31, as shown in FIG. 5. That is, the line head 10 is placed in the state shown in FIG. 5 during transportation and storage.

Figure 6:
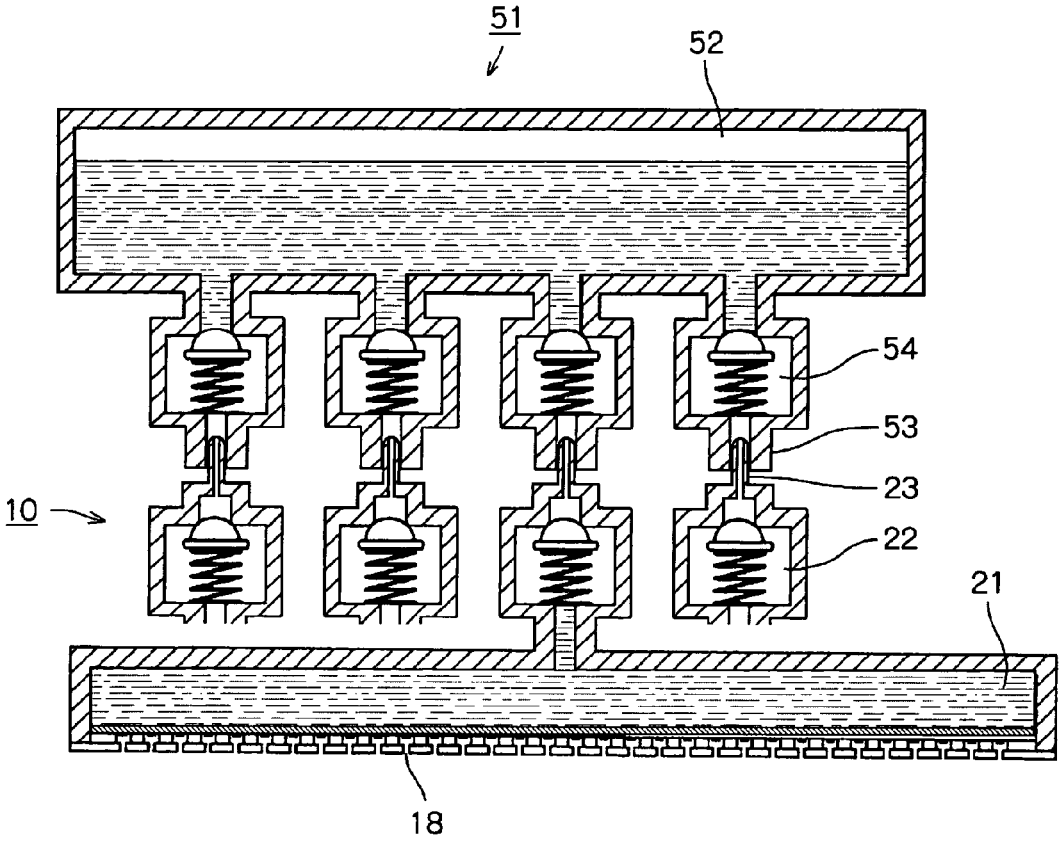
FIG. 6 is a partial sectional view of the line head in which the distribution container of the first embodiment is mounted.

FIG. 6 is a partial sectional view of the line head 10 to which the distribution container 51 of the first embodiment is attached. While the line head 10 has four common channels 21 corresponding to the ink colors, only one of the common channels 21 is shown in FIG. 6.

When the distribution container 51 is attached, as shown in FIG. 6, the upper ends of the ink supply tubes 23 are fitted in the mounting portions 53 to form supply paths for the storage liquid. That is, the storage liquid in the container body 52 can flow into the common channel 21 through the valve device 54, the ink supply tube 23, and the valve device 22.

The line head 10 is placed in the state shown in FIG. 6 during transportation and storage. When ink leaks from any of the nozzles 18 because of environmental factors such as vibrations during transportation and storage temperature, the storage liquid in the container body 52 is supplied to the common channel 21 in order to prevent air from flowing from the nozzle 18.

This operation will now be described in detail. When ink leaks from any nozzle 18, the inner pressure of the common channel 21 becomes negative. The valve device 22 is thereby opened, and the inner pressure of the mounting portion 53 connected thereto via the ink supply tube 23 also becomes negative. Consequently, the valve device 54 is opened, and the storage liquid in the container body 52 is supplied into the common channel 21. In this way, every time ink leaks from the nozzle 18, the inner pressure of the common channel 21 becomes negative, and the storage liquid is supplied into the common channel 21.

Therefore, even when ink leaks from any of the nozzles 18, the negative pressure in the common channel 21 is immediately removed by the supply of the storage liquid from the container body 52, and air is always prevented from flowing into the common channel 21 through the other nozzles 18. As a result, when the ink-jet printer 1 is used with the ink cartridges 41 mounted therein, as shown in FIG. 1, discharging failure due to bubbles, for example, no discharging or insufficient discharging of ink, does not occur, and degradation in printing quality is prevented.

Since the storage liquid is supplied from the container body 52 to the common channel 21, ink including the storage liquid is discharged when the ink-jet printer 1 is used. However, the storage liquid does not contain ink pigments, as described above, and is supplied only in a small amount. Therefore, the storage liquid does not have a substantial effect on the inks of the four colors Y, M, C, and K to be discharged for printing.

In the distribution container 51 of the first embodiment, the storage liquid is a transparent liquid having the same composition as that of the ink in this way, it can be commonly used for different colors while being stored in the single distribution container 51. Furthermore, since the distribution container 51 can be simultaneously attached to the cartridge holding sections 31, as shown in FIG. 4, handling is easy, and attachment error can be avoided.

Figure 7:
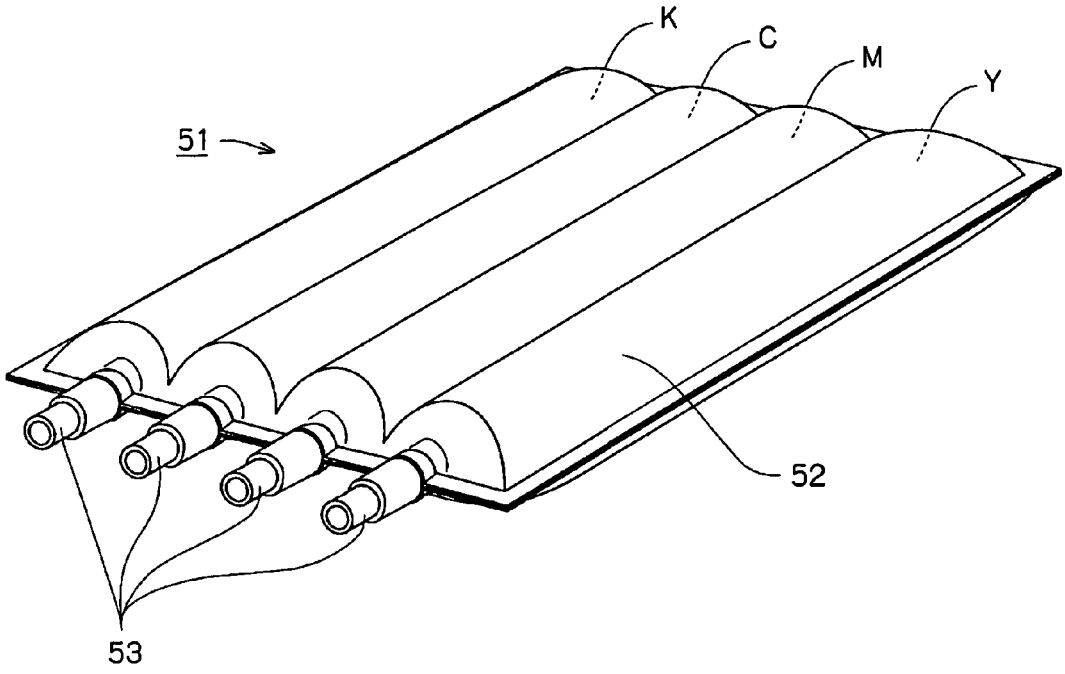
FIG. 7 is a perspective view of a distribution container according to a second embodiment of the present invention.

FIG. 7 is a perspective view of a distribution container according to a second embodiment of the present invention.

As shown in FIG. 7, a container body 52 of a distribution container 51 of the second embodiment includes four segments corresponding to the four cartridge holding sections 31 shown in FIG. 4. The segments are provided with respective mounting portions 53, and store inks of four colors, Y, M, C, and K, respectively.

The distribution container 51 of the second embodiment shown in FIG. 7 does not include the valve devices 54 provided in the distribution container 51 of the first embodiment shown in FIG. 3.

Figure 8:
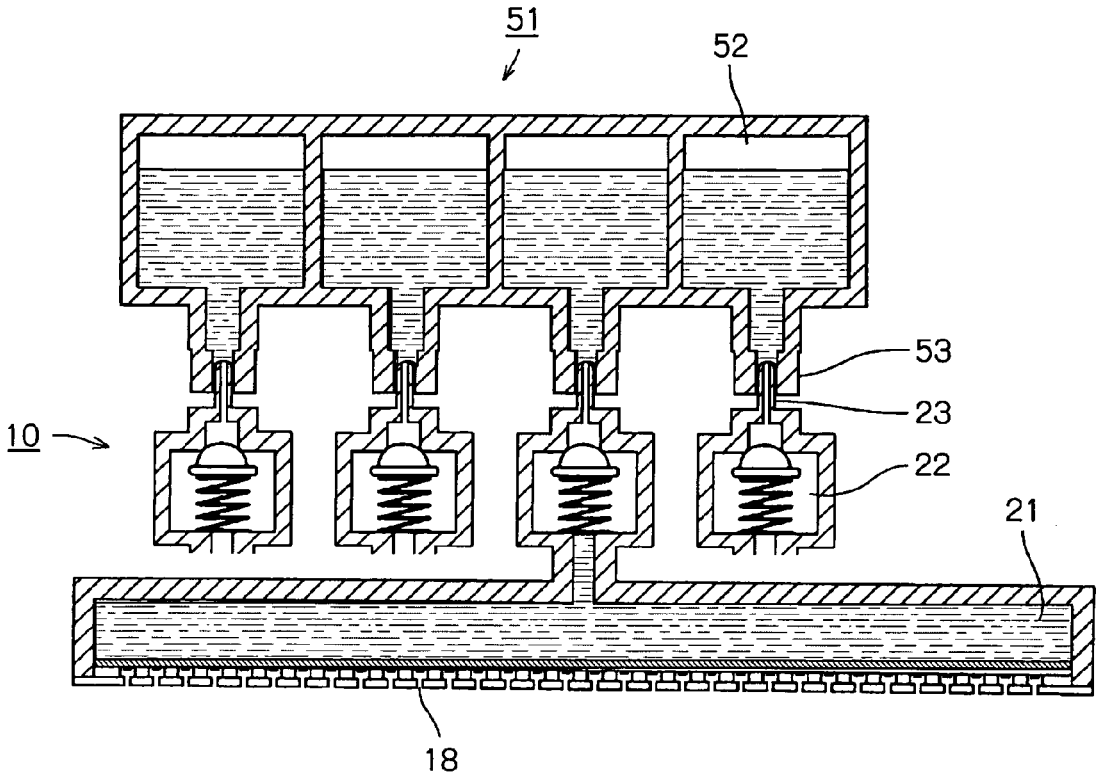
FIG. 8 is a partial sectional view of a line head in which the distribution container of the second embodiment is mounted.

FIG. 8 is a partial sectional view of a line head 10 to which the distribution container 51 of the second embodiment is attached. While the line head 10 includes four common channels 21 corresponding to the ink colors, only one of the common channels 21 is shown in FIG. 8.

In the distribution container 51 of the second embodiment, when the inner pressure of the common channel 21 becomes negative because of leakage of ink from any of the nozzles 18, the corresponding ink in the container body 52 is supplied into the common channel 21. Therefore, the negative pressure does not adversely affect the ink to be discharged for printing.

While the embodiments of the present invention have been described above, the present invention is not limited to the above embodiments, and the following modifications are possible.

While the line head 10 is used as the liquid-discharging head in the above embodiments, the present invention is similarly applicable to a serial head.

While the line head 10 capable of color printing is used in the above embodiments, similar advantages can be provided when the present invention is applied to a monochrome printing head. Furthermore, not only separate ink cartridges, but also a combination cartridge of four colors or three colors may be used in the color printing head.

While the line head 10 is detachable from the printer body 2 in the above embodiments, it may be provided integrally therewith. While the ink cartridges 41 are detachable from the line head 10, they may be provided integrally therewith.

While the distribution container and distribution method for the liquid-discharging head according to the present invention are preferably applied particularly to, for example, an ink-jet printer, they can be widely applied to other types of liquid-discharging heads.

For example, the present invention is also applicable to a liquid-discharging head for discharging dyes onto a material, and a liquid-discharging head for discharging a solution containing DNA in order to detect a biological material.

What is claimed is:

1. A distribution container mountable in at least one container holding section of a liquid-discharging head that discharges liquid through a nozzle from a liquid container mounted in the container holding section, the distribution container comprising:

a container body containing storage liquid; and at least one mounting portion to be attached to the container holding section, the at least one mounting portion connected to the container body via a valve device;

wherein, the distribution container is mounted in the container holding section to substitute for the liquid container during transportation and storage of the liquid-discharging head so that the storage liquid in the container body prevents air from flowing into the liquid-discharging head through the nozzle.

2. The distribution container according to claim 1, wherein the storage liquid is supplied from the container body to the liquid-discharging head to prevent the air from flowing through the nozzle when the inner pressure of the liquid-discharging head becomes negative.

3. The distribution container according to claim 1, wherein the container body is flexible.

4. The distribution container according to claim 1, wherein said at least one container holding section includes a plurality of container holding sections, the container body has a plurality of segments corresponding to said plurality of container holding sections, and said at least one mounting portion includes a plurality of mounting portions corresponding to said plurality of segments.

5. The distribution container according to claim 1, wherein the storage liquid in the container body does not contain a pigment contained in the liquid in the liquid container.

6. The distribution container according to claim 1, wherein said at least one container holding section includes a plurality of container holding sections, and said at least one mounting portion is simultaneously attached to said plurality of container holding sections.

7. The distribution container according to claim 1, wherein said valve device prevents the liquid from flowing out of the liquid container when said at least one mounting portion is not attached to the container holding section.

8. A distribution method for a liquid-discharging head that discharges liquid through a nozzle from a liquid container mounted in a container holding section, comprising a step of providing a distribution container containing storage liquid to be mounted in the container holding section to substitute for the liquid container during transportation and storage of the liquid-discharging head so that the storage liquid prevents air from flowing into the liquid-discharging head through the nozzle, the distribution container having a container body containing the storage liquid and at least one mounting portion to be attached to the container holding section and connected to the container body via a valve device.

9. The distribution method according to claim 8, wherein the storage liquid is supplied from the distribution container to the liquid-discharging head to prevent the air from flowing through the nozzle when the inner pressure of the liquid-discharging head becomes negative.

10. The distribution method according to claim 8, wherein said at least one container holding section includes a plurality of container holding sections, and the distribution container has a plurality of segments corresponding to said plurality of container holding sections.

11. The distribution method according to claim 8, wherein the storage liquid in the distribution container does not contain a pigment contained in the liquid in the liquid container.

* * * * *